United States Patent [19]

Heide et al.

[11] Patent Number: 4,800,884

[45] Date of Patent: Jan. 31, 1989

[54] MAGNETIC INDUCTION HEARING AID

[75] Inventors: Jorgan Heide, Cordova; Timothy D. Gooch, Memphis; Anthony D. Prescott, Germantown; Thomas W. Sander, Memphis; Jim Davidson, Germantown; Eric A. Renz, Memphis, all of Tenn.

[73] Assignee: Richards Medical Company, Memphis, Tenn.

[21] Appl. No.: 837,708

[22] Filed: Mar. 7, 1986

[51] Int. Cl.[4] ..... H04R 25/00

[52] U.S. Cl. ..... 128/419 R

[58] Field of Search ..... 128/419 R, 420.5, 420.6; 381/68, 68.1, 68.2

[56] References Cited

U.S. PATENT DOCUMENTS

| | | | |
|---|---|---|---|
| 3,870,832 | 3/1975 | Fredrickson | 381/68.3 |
| 4,419,995 | 12/1983 | Hochmair et al. | 128/420.6 |
| 4,467,145 | 8/1984 | Borstel | 381/68 |
| 4,539,440 | 9/1985 | Sciarra | 381/68 |
| 4,606,329 | 8/1986 | Mough | 128/420.6 |

FOREIGN PATENT DOCUMENTS

| | | | |
|---|---|---|---|
| 3243850 | 5/1984 | Fed. Rep. of Germany | 381/68 |
| 3431584 | 3/1986 | Fed. Rep. of Germany | 381/68 |

OTHER PUBLICATIONS

J. Fredrickson, D. Tomlinson, E. Davis and L. Odkvist, *Evaluation of an Electromagnetic Implantable Hearing Aid,* Canadian Journal of Otolaryngology, vol. 2, No. 1, 1973, pp. 53–62.

W. Ruthen, M. Peters, C. Brenkman, H. Mol, J. Grote and L. van der Marel, *The Use of a SQUID Magnetometer for Middle Ear Research,* Cryogenics, Sep. 1982, pp. 457–460.

W. Ruthen, C. Blitterswijk, C. Brenkman and J. Grote, *Vibrations of Natural and Artificial Middle-Ear Membranes Measured by a Squid Magnetometer.*

R. Goode and T. Glattke, *Audition via Electromagnetic Induction,* Arch Otolaryngol, Jul. 1973, pp. 23–26.

R. Goode, *An Implantable Hearing Aid,* Tr. Am. Acad. Opth. & Otol., Jan.–Feb. 1970, pp. 128–139.

J. Vernon, T. Mahoney, and A. Schlevning II, *Implantable Hearing Aids,* pp. 249–268.

*Primary Examiner*—William E. Kamm

*Assistant Examiner*—Timothy Keegan

*Attorney, Agent, or Firm*—Pravel, Gambrell, Hewitt, Kimball & Krieger

[57] ABSTRACT

A magnetic induction hearing aid where the microphone, the amplifying electronics, the battery and a coil are contained in a single housing which is located deep in the ear canal. A magnet is attached to portions of the middle ear by means of a malleus clip or by implantation between the tympanic membrane and the malleus. The magnet is vibrated by interaction with the magnetic field produced by the coil. Two amplifier designs are disclosed for use with different levels of hearing loss. The magnet can be coated with hydroxyapatite for permanent attachment to the body. The magnet is coated with hydroxyapatite by an ion implantation process, a plasma spraying technique or a method of applying the hydroxyapatite while a precoating polymeric material has not fully solidified.

12 Claims, 6 Drawing Sheets

MAGNETIC INDUCTION HEARING AID

BACKGROUND OF THE INVENTION

1. Field of the Invention

The present invention relates to hearing aids and, more particularly, to a hearing aid using magnetic induction to reproduce sound.

2. Description of the Prior Art

Hearing aids are useful in restoring lost aural perception to those persons having mild or severe loss of hearing. Conventional hearing aids have a microphone, amplifier circuitry, a battery and a speaker. The microphone receives the sound energy and transforms the sound energy into an electrical signal which is then amplified and filtered. This amplified signal is transformed back to acoustic energy by the speaker and transmitted to the person's middle ear for perception of the sound. These hearing aids can be placed behind the ear, with only the receiver being placed inside the ear canal. Alternatively, in-the-ear hearing aids are available which are placed in the outer ear and have portions extending into the ear canal.

There are a number of problems with conventional hearing aids. All conventional hearing aids are visible to some extent and therefore have an undesirable cosmetic appearance. Conventional hearing aids have acoustic feedback problems because sound energy can escape from the ear canal and be detected by the microphone, generating a feedback-related whistle. Additionally, sound reproduction is often lacking in clarity because of distortions generated by standing waves existing in the closed cavity between the hearing aid and the tympanic membrane and poor mechanical reproduction by the speaker.

It has been suggested that a magnetic induction hearing aid would remove many of these problems. A magnet or other item having a magnetic field is placed in the middle ear, either in contact with the tympanic membrane or in contact with other portions of the middle ear. Electrical circuitry and a coil would generate a magnetic field having the same frequency as the external sound. The magnetic field generated by the coil would interact with the field of the magnet and cause the magnet to vibrate at the same frequency as the magnetic field. The vibration of the magnet would then cause the attached portion of the middle ear to vibrate, resulting in a perception of the external sound.

A magnetic induction hearing aid would overcome feedback or distortion problems of conventional hearing aids because there would be no significant air movement in the ear canal, resulting in insufficient energy escaping around the hearing aid to generate a feedback problem. There would be no standing waves generated to cause distortion because there are no appreciable sound waves at all.

Attempts to use magnetic induction hearing aids have been reported. An early attempt placed a coil in conjunction with a small piece of iron on the tympanic membrane, which was excited by an external coil placed over the ear canal. This system did allow the perception of the stimulus, but had the side effect of producing discomfort and pain for the wearer. A later attempt glued a small magnet to the umbo and used an external coil placed over the ear of the wearer to cause the sympathetic vibrations of the magnet. This apparatus required approximately 7.9 ma to produce a 0 db hearing level at 1000 Hz.

In an article entitled *Audition via Electromagnetic Induction,* Arch Otolaryngol 23 (July 1973), Goode et al describe a number of tests. One test attached a magnet to the tympanic membrane and located a coil in the ear canal 3 mm from the magnet. The coil was driven externally by an audiometer. This development required only 0.7 $\mu$a to produce a 0 db hearing level at 1000 Hz. Tests were performed for system fideltiy and proved adequate. Another system tested placed the coil over the ear, drove the coil with an audiometer and had a magnet glued to portions of the middle ear, but used larger magnets than in previous tests. One version of this system placed the magnet on a Silverstein malleus clip which was connected in the normal manner. Approximately 0.7 ma was required to produce a 0 db hearing level using these arrangements.

These discussions suggested that the use of electromagnetic induction to produce a hearing aid is possible, but did not teach a way to develop a practical system. The majority of tests used coils placed over the ear or adjacent to the ear. Systems using external coils are not efficient enough for use in conjunction with the low power requirements dictated by hearing aid batteries. Although one test indicated that a coil was placed inside the ear canal, an external amplifier was used to drive the coil. The tests did not result in a practical device or suggest how a totally in-the-ear device could be made.

Further, the magnets described in conjunction with the above-mentioned tests were either glued to portions of the middle ear and removed after short periods of time or were connected to malleus clip and inserted for a longer duration. Neither of these attempts resulted in a magnet that could be implanted for extended periods of time with no danger of rejection by the body, have no movement in relation to the middle ear and yet have as little weight as possible.

SUMMARY OF THE INVENTION

The present invention is directed to a magnetic induction, in-the-ear hearing aid where all the elements of the hearing aid are placed within the ear canal and the middle ear. A microphone, amplifying electronics, battery and driving coil are placed within a single housing which is custom molded for each wearer and placed deep within the ear canal. A magnet can either be mounted on a Silverstein malleus clip and connected to the malleus or coated with hydroxyapatite or similar material that allows tissue in the eardrum to adhere to the magnet and installed between the eardrum and the malleus.

The amplifier is one of two types, either Class A or Class B, depending on volume levels required. The coils are matched to the particular amplifier type to provide optimal efficiency for a given design. The coil is formed of a number of turns of wire wound over a mumetal core, which is used to increase magnetic field strength. The coil is placed close to the magnet to allow optimal coupling of the magnet's field with the magnetic field produced by the coil.

The magnet is formed of a neodymium-iron material allowing a very high strength magnetic field to be developed by a very small magnet. Since this material corrodes when placed in an animal body, it is coated with a biocompatible material if the magnet is installed on a Silverstein malleus clip for connection to the middle ear.

Alternatively, if the magnet is implanted behind the tympanic membrane, it can be coated with hydroxyapatite or other material that protects the magnet from corrosion and allows the magnet to become permanently bonded to the body by the adherence of body tissue to the hydroxyapatite. The magnet may have an underlying coating of other bio-compatible materials so that the magnet is sealed and to allow the hydroxyapatite to better adhere to the magnet. This initial coating or precoat of the magnet can be formed of gold or a number of biocompatible polymers.

The hydroxyapatite can be applied using an ion implantation technique to allow the coating to be performed at low temperatures, which are necessary to prevent demagnetization of the magnet. An alternative process for applying the hydroxyapatite is a plasma spraying technique where the magnet is kept sufficiently cool to prevent demagnetization. Yet another method for applying the hydroxyapatite involves depositing the hydroxyapatite on the magnet surface before the polymer coating is completely solidified.

BRIEF DESCRIPTION OF THE DRAWINGS

A better understanding of the invention can be obtained when the detailed exemplary embodiment set forth below is considered in conjunction with the following drawings, in which.

DETAILED DESCRIPTION OF EXEMPLARY EMBODIMENTS

Figure 1:
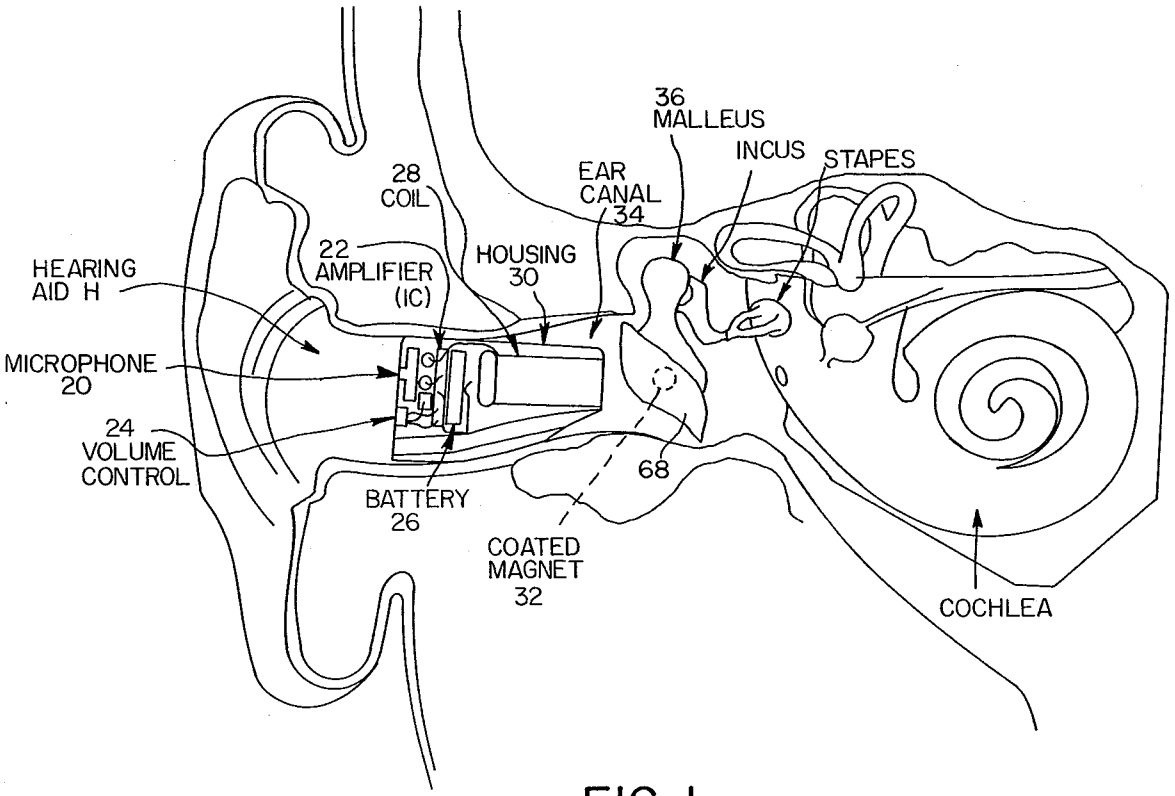
FIG. 1 is a cross-sectional view of a human ear with a magnetic induction hearing aid according to the present invention placed in the ear canal.

Referring to FIG. 1, the letter H refers generally to a hearing aid according to the present invention and is shown installed in an ear canal 34. The hearing aid H has a housing 30 enclosing a microphone 20, an amplifier 22, a volume control 24, a battery 26 and a coil 28. The hearing aid H is located deep in the ear canal 34 so that the coil 28 is located near a coated magnet 32, with 2.5 mm being a desirable distance for this separation. This distance is sufficiently close to reduce the inverse relationship of distance to magnetic field strength and yet is sufficiently far that the hearing aid H can be inserted by the wearer with minimal difficulty and not be in danger of contacting the tympanic membrane 68.

The installation of the hearing aid H deep within the ear canal 34 as shown in FIG. 1 eliminates any negative cosmetic effects of a hearing aid because the hearing aid H is practically undetectable. A conventional hearing aid cannot be inserted this deep in the ear canal 34 because of the standing wave and feedback problems discussed above. These problems do not occur in a magnetic induction hearing aid and therefore this deep placement is possible.

Volume adjustment and battery replacement is accomplished by removing hearing aid H from the ear canal 34, appropriately adjusting the volume control 24 or replacing the battery 26 and reinserting the hearing aid H into the position shown in FIG. 1.

The housing 30 is custom molded to each wearer's ear canal 34. This is necessary because each wearer has a differently sized and shaped ear canal. The hearing aid H must be sufficiently close to the magnet 32 for proper operation and the hearing aid H must be sufficiently tight within the ear canal 34 to remain in place during normal use.

Figure 2:
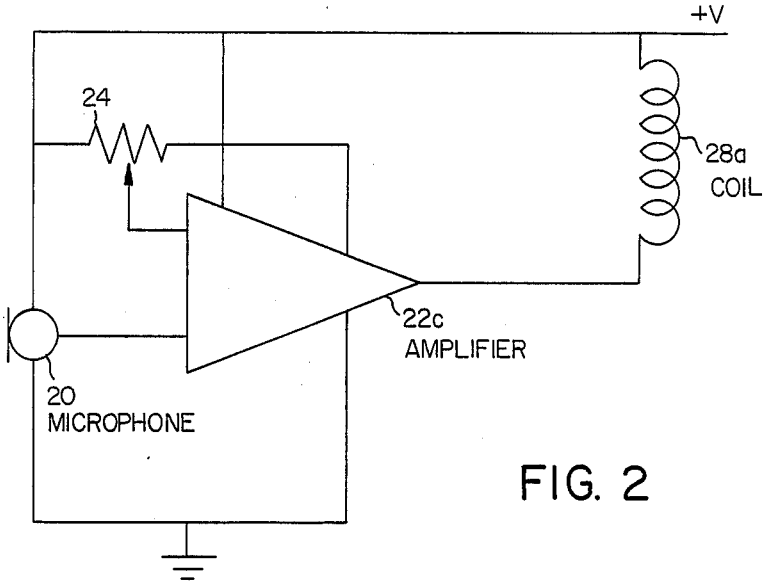
FIG. 2 is an electrical schematic diagram of one embodiment of a circuit utilizing a Class A amplifier designed according to the present invention.

A class A amplifier design is shown in FIG. 2. The microphone 20 is a standard electret microphone as conventionally used in hearing aids. The amplifier 22*c* is class A design that is standard in hearing aid applications. This amplifier is specifically designed for low voltage operation in conjunction with a single 1.3 volt battery. The volume control 24 is connected to vary the gain of the amplifier 22*c* and thereby change the output signal level applied to the coil 28*a*. The coil 28*a* is designed for use with the class A amplifier 22*c*.

Figure 8A:
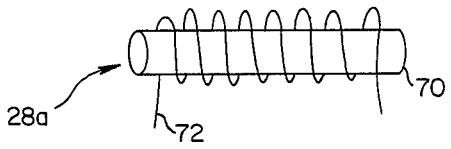
FIGS. 8*a*, 8*b* and 8*c* are schematic illustrations of coils formed according to the present invention.

Each amplifier used in hearing aids has a recommended output load impedance which is normally deemed to be the speaker or receiver impedance. For optimum performance of the hearing aid H, the coil 28*a* should be designed to match this characteristic desired impedance across as wide a frequency band as possible. The coil 28*a* is a double-ended coil designed to be connected to the battery 26 and to the output of the amplifier 22*c*. The coil 28*a* is formed by winding the appropriate number of turns of wire 72 (FIG. 8*a*) about a high permeability core 70. Preferably, the core 70 is comprised of mumetal to increase the magnetic field strength at the ends of the coil. The maximum coil size is preferably approximately 9 mm long and 4 mm in diameter. This size limitation is used in conjunction with the optimum coil impedance in determining the number of turns of wire 72 and the gauge of the wire 72 to produce a coil of the allowed size having the desired impedance.

Figure 3:
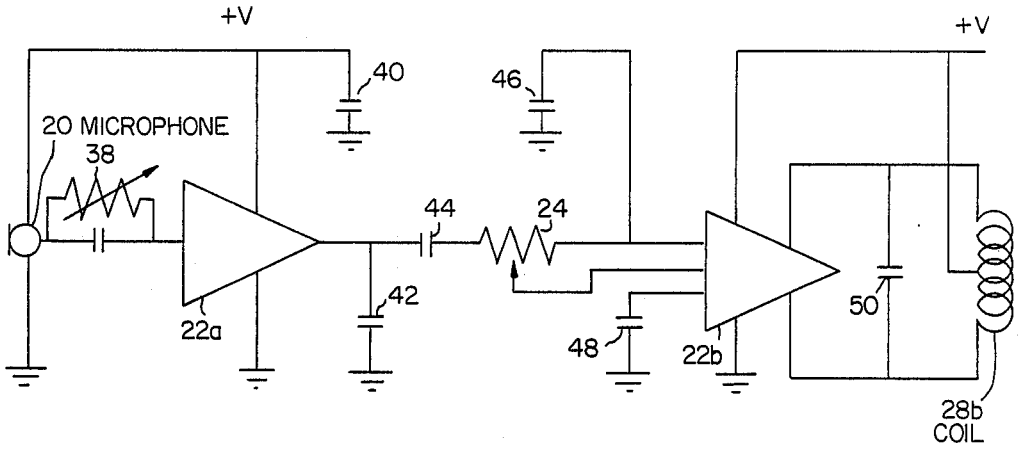
FIG. 3 is an electrical schematic diagram of a second embodiment of a circuit utilizing a Class B amplifier designed according to the present invention.

The class A amplifier 22*c* is used in situations where the wearer has only a mild to moderate loss of hearing. The class A design is used in the mild loss case because the power consumption of the class A amplifier 22*c* is lower, but the maximum output is also lower, necessitating a higher performance or class B design for high power needs.

Where the wearer has a more severe hearing loss requiring greater amplification of the sound signal, what is known as a class B amplifier design as shown in FIG. 3 is used. A class B amplifier 22*b* is used in the higher volume, higher amplification situations because it has a power output level higher than that of the class A amplifier 22*c*. The trade off for this efficiency is reduced battery life because of the higher current draw of the class B amplifier design.

Figure 8B:
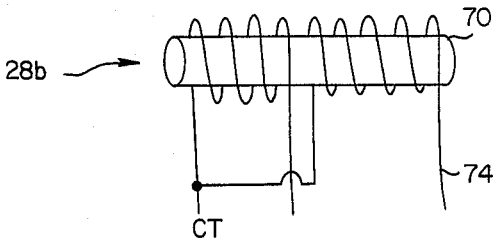
Figure 8C:
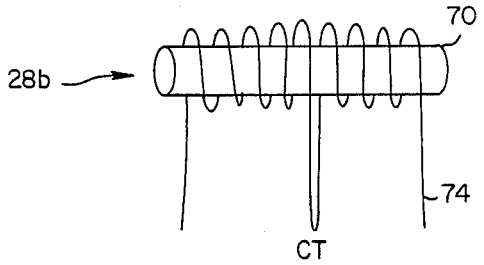

The microphone 20 is connected to a preamplifier stage 22*a* through an impedance matching and filter stage 38. The class A preamplifier 22*a* provides a fixed amount of gain and produces an output signal which is transmitted to filter capacitors 42 and 44 and the volume control 24. Appropriately adjusting the volume control 24 changes the output voltage of the class B output amplifier **22*b* which in turn drives coil 28*b*. As in the class A amplifier 22*c*, the class B output amplifier 22*b* has an optimal load impedance resistor which is specified by the manufacturer. The coil 28*b* is designed to have an impedance which matches this optimal impedance over as broad a frequency band as is necessary for the given application. The coil 28*b* is designed with a center tap (FIGS. 8*b* and 8*c*) to allow use with the class B amplifier 22*b*. An appropriate number of turns of the appropriate gauge wire 74 are wound around the mu-metal core 70 or other high permeability material and connected as required to the amplifier 22*b*. The class B amplifier 22*b* produces greater power because of its class B design and its push-pull operation, enabling the coil 28*b* to produce larger magnetic field densities and thereby move the magnet 32** a greater distance.

Figure 7:
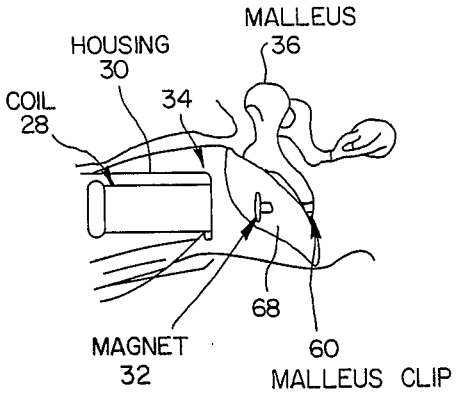
FIG. 7 is a cross-sectional view of an eardrum or tympanic membrane and malleus in which a magnet mounted to a malleus clip is connected to the malleus.
Figure 5C:
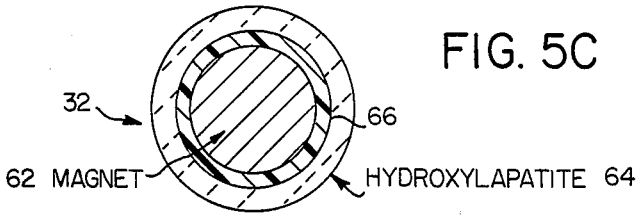
FIGS. 5*a*, 5*b*, 5*c* and 5*d* are, respectively, cross-sectional top and side views of a magnets formed according to the present invention.
Figure 5D:
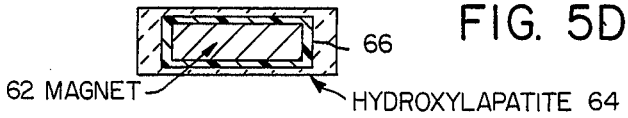
Figure 6:
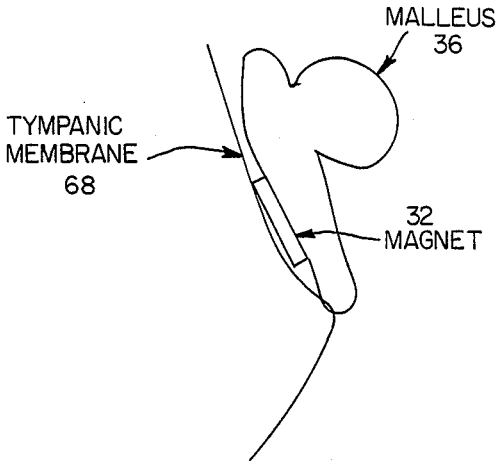
FIG. 6 is a partial cross-sectional view of a middle ear showing an magnet implanted according to the present invention.
Figure 5A:
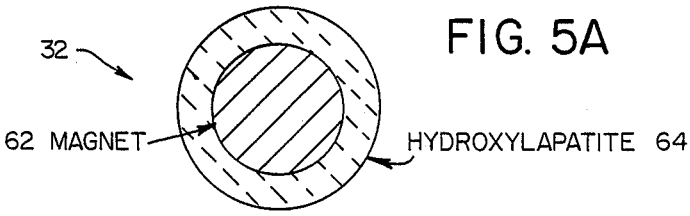
Figure 5B:
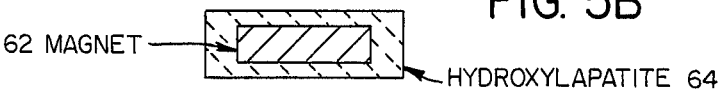

The coil 28 produces a magnetic field varying at the frequency of the sound waves received by the microphone 20. The coil's magnetic field then interacts with the magnet 32. A sympathetic vibration of the magnet 32 occurs at the frequency of the sound waves. This mechanical vibration of the magnet 32 is then translated into movement of either the malleus 36 if the magnet 32 is attached to a malleus clip 60 (FIG. 7) or to vibration of the malleus 36 and the tympanic membrane 68 if the magnet 32 is inserted between the malleus 36 and the tympanic membrane 68 as shown in FIG. 6.

It is desirable that the coil 28 be placed in close proximity to the magnet 32 because a magnetic field decreases with strength according to an inverse law. Therefore, the coil's magnetic field effecting and interacting with the magnet 32 is radically diminished as the separation distance increases. This diminishing interaction directly effects the efficiency of the hearing aid H and therefore a minimum gap is desirable.

If the magnet 32 is implanted behind the tympanic membrane 68, the magnet 32 can move by either of two actions. The first movement is a piston-type action perpendicular to the plane of the membrane 68. The second action of the magnet 32 is a rocking action about a horizontal axis of the magnet 32. This rocking does cause the tympanic membrane 68 and the malleus 36 to vibrate, creating a sensation of sound. The rocking action is preferable because there is better magnetic coupling between the magnet 32 and the coil field, which increases effective acoustic gain and thereby system efficiency.

To aid generation of the rocking action of the magnet 32, it is preferable that the coil axis be at an angle, preferably 45 degrees, to the plane of the magnet 32. Lesser angles increase the likelihood of the less desirable piston action, while greater angles reduce magnetic coupling because of the shape of the coil's magnetic field.

The mass of the magnet 32 must be kept at a minimum to further increase the efficiency of the design so that the coil's magnetic field does not have to oscillate a larger mass and therefore require a larger energy transfer between the coil 28 and the magnet 32. But the magnet 32 must also be high strength so that the two interacting magnetic fields, the coil field and the magnet field, are sufficiently strong to create a large amount of coupling between the two fields. For this reason it is preferable that the magnet 32 be formed from the neodymium-iron which has an extremely high field strength for a given magnet size.

Because the magnet 32 is to be inserted in the human body it is necessary that the magnet 32 or magnet assembly be biocompatible and not corrode when placed in the body. It is also desirable that the magnet become firmly and permanently attached to the desired portions of the middle ear.

The preferred neodymium-iron magnet, in and of itself, does not meet these requirements. It corrodes when placed in the body and therefore is not suitable in its uncoated state for long-term placement or installation. Therefore, for biocompatibility the magnet 32 must be coated and sealed with a biocompatible material. There are two alternative versions of the coated magnet 32, one for use with malleous clip 60 and the other for direct implantation between the tympanic membrane 68 and the malleous 36.

Figure 4:
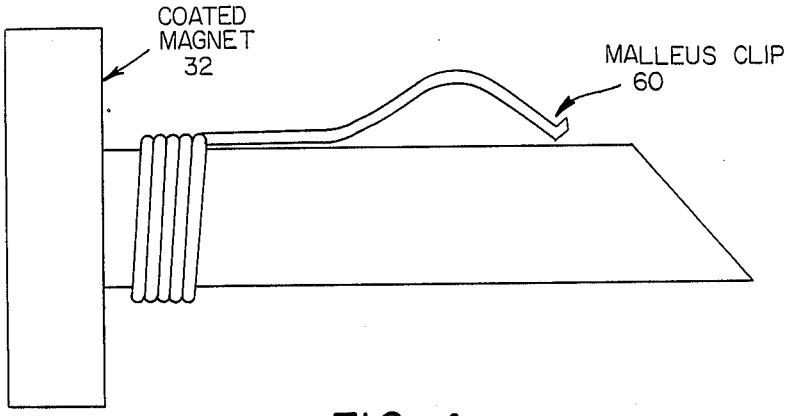
FIG. 4 is a side view of a malleus clip having a magnet mounted thereon.

The magnet 32 that is attached to the malleous clip 60 (FIG. 4) need only be biocompatible such that it does not produce an infection and does not corrode. For this use, a coating of the magnet with biocompatible materials such as gold or other nonresorbable, biocompatible material such as various commonly available polymers is necessary. No actual mechanical bonding between the magnet 32 and portions of the middle ear is necessary because the malleous clip 60 provides the connection with the malleous 36 and the magnet 32 is firmly mounted on the malleous clip 60.

For the embodiment of the magnet 32 to be used for direct implantation between the tympanic membrane 68 and the malleous 36, different criteria must be considered. It is highly desirable that this magnet 32 be coated with a bioactive material which will form a permanent bond with the middle ear. To this end it is preferable that the magnet 62 (FIGS. **5*a*, 5*b*, 5*c*, 5*d*) be coated with hydroxyapatite 64**. Hydroxyapatite is a calcium phosphate material which has a particular crystal structure which resists biodeterioration and has an outer surface that easily adheres to tissue that is generated by the adjacent body portion.

Hydroxyapatite is preferred as the material that is useable as an outer coating material, but other nonresorbable bioactive materials could be used. Hydroxyapatite is referred to in this specification because it is the preferred material at this time and references to hydroxyapatite are intended to include other similar materials. Coating the magnet 62 with hydroxyapatite 64 and placing the coated magnet 32 between the tympanic membrane 68 and the malleous 36 results in the magnet 32 becoming part of the middle ear after a period of time due growth of middle ear tissue and its adherance to the hydroxyapatite coating 64.

A coating of hydroxyapatite 64 over a bare magnet 62 might possibly be satisfactory if the magnet were sealed from surrounding body fluids. However, because a neodymium-iron magnet is highly corrodable in an animal body and a complete seal is difficult to achieve, the magnet 62 first receive a precoating 66 prior to the final coating of hydroxyapatite 64. This precoating 66 is used to seal the magnet 62 from the bodily environment and therefore resist corrosion. The sealant can be a biocompatible material such as gold or other biocompatible polymers as are used in implantable medical devices. The precoated magnet is then coated with the hydroxyapatite 64 or other nonresorbable bioactive materials with similar properties.

There are several different processes that could be used for applying the hydroxyapatite coating. The first process is an ion implantation or sputtering technique where the target magnet is placed inside a vacuum chamber and positioned near a hydroxyapatite source. The hydroxyapatite source is then bombarded by an electron beam source from an ion accelerator so that the hydroxyapatite atoms are stripped from the source material and attracted to the target material due to electrostatic forces. Alternatively, a hydroxyapatite plasma can be produced by a radio frequency power source and directed toward the target material. The charged hydroxyapatite atoms are then driven into the magnet 62 or the precoat 66 by means of an accelerated argon ion beam. This firmly implants the hydroxyapatite atoms into the magnet 62 or precoat 66 forming a firm bond between the two layers. This process is continued until a sufficient hydroxyapatite coating thickness is produced, preferably about one micron.

The ion implantation process is a low temperature process which allows the magnet 62 to retain its magnetism. If the magnet 62 is subjected to a sufficiently high temperature, it loses its magnetism and therefore is rendered unusable. For this reason, the target must be kept at a low temperature which is capable of being done in the ion implantation or sputtering technique.

A low temperature process is also important so that the hydroxyapatite source material retains its hydroxyapatite structure. If the materials forming the hydroxyapatite are elevated to a sufficiently high temperature, the hydroxyapatite converts to tricalciumphosphate which is a bioresorbable material and is not satisfactory for coating the magnet 62. This is because the material is resorbed by the body and would eventually disappear from the magnet 62, leaving the magnet 62 uncoated and not bonded as desired. Therefore the low temperature ion implantation technique allows the hydroxyapatite 64 to keep its structure after being sputtered on the target magnet.

A second process for coating the precoated magnet is a plasma spraying technique. In this process the hydroxyapatite 64 is in the form of a powder and is fed through an argon plasma which melts the hydroxyapatite powder which is then fired onto the surface of the target magnet. The hydroxyapatite 64 then cools down, solidifies and is bonded to the precoating material 66. In this process it is possible to keep the substrate or target material temperature sufficiently low so as not to demagnetize the magnet 62.

A third process for applying the hydroxyapatite coating material involves placing the hydroxyapatite material on the surface of the polymer used as the precoat 66 before the polymer precoating material is fully solidified. When the biocompatible precoating polymer material 66 is applied to the magnet 62 in a molten form there is an interval wherein the precoating material 66 is sufficiently adhered to the magnet 62 and yet is not completely solidified. During this tacky or partially fluid state, the hydroxyapatite material is introduced onto the magnet assembly and physically pressed into the precoating material 66, therefore bonding with the precoating material 66 which then completes its hardening process. In this way, the hydroxyapatite material 64 has fully interlaced with the precoating polymer 66 which is firmly attached and sealing the magnet 64. An intermediate biocompatible coating attached to the underlying precoating material 66 can also be used to bond the hydroxyapatite 64 to the magnet 62.

The foregoing disclosure and description of the invention are illustrative and explanatory of the invention, and various changes in the size, shape and materials, as well as in the details of the illustrated construction and process may be made without departing from the spirit of the invention, all of which are contemplated as falling within the scope of the appended claims.

We claim:

1. A magnetic induction hearing aid, comprising:

housing means with an outer surface shaped and dimensioned to fit entirely in an animal ear canal;

microphone means located in said housing means for producing an electrical signal in response to received sound waves;

amplifier means located in said housing means for amplifying said microphone means signal;

electrical power means located in said housing means for powering said amplifier means;

magnetic coil means located in said housing means and driven by said amplifier means for producing a magnetic field indicative of the received sound waves;

magnet means affixed to a portion of the middle ear and wherein the magnet means is induced into movement by the magnetic field produced by the coil means such that the magnet means produces movement of the middle ear indicative of the received sound waves.

2. The hearing aid of claim 1, wherein the magnet means includes means for connecting the magnet means to the tympanic membrane.

3. The hearing aid of claim 1, wherein the magnet means includes a malleous clip which is adapted to clip to the malleous of the middle ear.

4. The hearing aid of claim 1, wherein the amplifier means comprises a class A amplifier.

5. The hearing aid of claim 1, wherein the amplifier means comprises a class B output stage and the coil means comprises a center tapped coil.

6. The hearing aid of claim 1, wherein the longitudinal axis of the coil means is oriented at an angle to the plane of the magnet means.

7. The hearing aid of claim 6, wherein said angle is 45 degrees.

8. The hearing aid of claim 1, wherein the magnet means is formed of neodymium and iron.

9. The hearing aid of claim 1, wherein the magnet means includes an outer coating formed of hydroxyapatite.

10. The hearing aid of claim 9, further including a precoating material under the outer coating for sealing the magnet means.

11. The hearing aid of claim 1, wherein the coil means comprises a high permeability core material and a plurality of turns of wire.

12. The hearing aid of claim 11, wherein the core material is formed of mumetal.

* * * * *

UNITED STATES PATENT AND TRADEMARK OFFICE
Certificate

Patent No. 4,800,884 Patented: Jan. 31, 1989

On motion pursuant to 37 CFR 1.634 in Interference No. 102,292, it has been found that the above-identified patent, through error and without any deceptive intention, incorrectly sets forth the inventorship. Accordingly, pursuant to 35 U.S.C. 256 it is hereby certified that the correct inventorship of this patent is:
Jorgan Heide, Timothy D. Gooch, Anthony D. Prescott and Thomas W. Sander.

Signed and Sealed this Eighteenth Day of December 1990.

STANLEY M. URYNOWICZ, Jr.

*Examiner-in-Chief*
*Board of Patent Appeals*
*and Interferences*

UNITED STATES PATENT AND TRADEMARK OFFICE

CERTIFICATE OF CORRECTION

PATENT NO. : 4,800,884

DATED : January 31, 1989

INVENTOR(S) : Jorgen Heide, et al.

It is certified that error appears in the above-identified patent and that said Letters Patent is hereby corrected as shown below:

ON THE TITLE PAGE

Item [75] Inventors: delete "Jorgan" and insert --Jorgen--.

delete inventors "Jim Davidson and Eric A. Renz".

At column 2, line 10, delete "fideltiy" and insert -- fidelity --.

At column 5, line 6, delete "impedance resistor" and insert -- impedance resistance --.

At column 7, line 35, delete "sputtered on" and insert -- sputtered to --.

At column 7, line 62, delete "magnet 64" and insert -- magnet 62 --.

At column 8, line 26, delete "ear and" and insert -- ear; and --.

Signed and Sealed this

Third Day of March, 1992

*Attest:*

HARRY F. MANBECK, JR.

*Attesting Officer*

*Commissioner of Patents and Trademarks*